US008418421B1

(12) United States Patent
Saebi

(10) Patent No.: US 8,418,421 B1
(45) Date of Patent: Apr. 16, 2013

(54) METHOD OF PROVIDING A CONNECTION BETWEEN A CONCRETE SLAB OR FLOOR AND A COMPOSITE WALL

(76) Inventor: Nasser Saebi, Glendale, AZ (US)

( * ) Notice: Subject to any disclaimer, the term of this patent is extended or adjusted under 35 U.S.C. 154(b) by 0 days.

(21) Appl. No.: 12/932,698

(22) Filed: Mar. 3, 2011

Related U.S. Application Data

(63) Continuation of application No. 12/231,154, filed on Aug. 28, 2008, now abandoned.

(60) Provisional application No. 60/967,050, filed on Aug. 31, 2007.

(51) Int. Cl.
*E04C 1/00* (2006.01)

(52) U.S. Cl.
USPC ..... 52/309.17; 52/745.21

(58) Field of Classification Search ..... 52/309.17, 52/309.12, 741.13, 745.21
See application file for complete search history.

(56) References Cited

U.S. PATENT DOCUMENTS 5,685,115 A * 11/1997 Colfer ..... 52/292
2004/0111989 A1* 6/2004 Stephens et al. ..... 52/264
2005/0247012 A1* 11/2005 Williams ..... 52/742.14

* cited by examiner

*Primary Examiner* — Jeanette E Chapman
*Assistant Examiner* — Daniel Kenny
(74) *Attorney, Agent, or Firm* — Albert W Davis, Jr.

(57) ABSTRACT

The invention provides a method for connecting a foam structure to a concrete slab or floor. The connection uses a metal member and bonding agents between the foam and the metal member and bonding agents between the concrete slab or floor and the metal members.

6 Claims, 6 Drawing Sheets

METHOD OF PROVIDING A CONNECTION BETWEEN A CONCRETE SLAB OR FLOOR AND A COMPOSITE WALL

This application is continuation of a non-provisional patent application Ser. No. 12/231,154 filed Aug. 28, 2008 now abandoned by Nasser Saebi for A METHOD OF PROVIDING A CONNECTION BETWEEN A CONCRETE SLAB OR FLOOR AND A COMPOSITE WALL which claims priority to provisional patent application Ser. No. 60/967,050, filed Aug. 31, 2007 by Nasser Saebi.

The following references are incorporated by reference: U.S. Pat. No. 6,308,490 issued Oct. 30, 2001 and U.S. Pat. No. 6,912,488 issued Jun. 28, 2005 to Nasser Saebi for Method of Constructing Curved Structures as Part of a Habitable Building, U.S. Pat. No. 6,721,684 issued Apr. 13, 2004 and U.S. Pat. No. 6,985,832 issued Jan. 10, 2006 to Nasser Saebi for Method of Manufacturing and Analyzing a Composite Building.

BACKGROUND OF THE INVENTION

The invention relates to the construction of composite buildings and structures with a core of plastic foam and a Fiber Reinforced Coating on the opposing surfaces of the core.

BRIEF SUMMARY OF THE INVENTION

Composite buildings of this invention use a plastic foam core having Fiber Reinforced Coatings (FRCs) on the inner and outer surfaces of the core. For example, the foam core can be Expanded PolyStyrene (EPS), and the FRC can be Glass Fiber Reinforced Concrete (GFRC).

GFRC has a coefficient of thermal expansion that is ⅓ of that of a concrete slab/floor. Thus, if the GFRC of the wall is used to bond the wall to a concrete floor, the GFRC will crack along the joint area between the wall and the floor. Further, during setting of the GFRC coating, there is shrinkage of the coating due to water loss which will also cause cracking and loss of strength.

To overcome this problem and create a very strong connection between the wall and the floor, the invention provides a robust connection between the foam core and the floor to provide a structural connection.

DETAILED DESCRIPTION OF THE INVENTION

Figure 1:
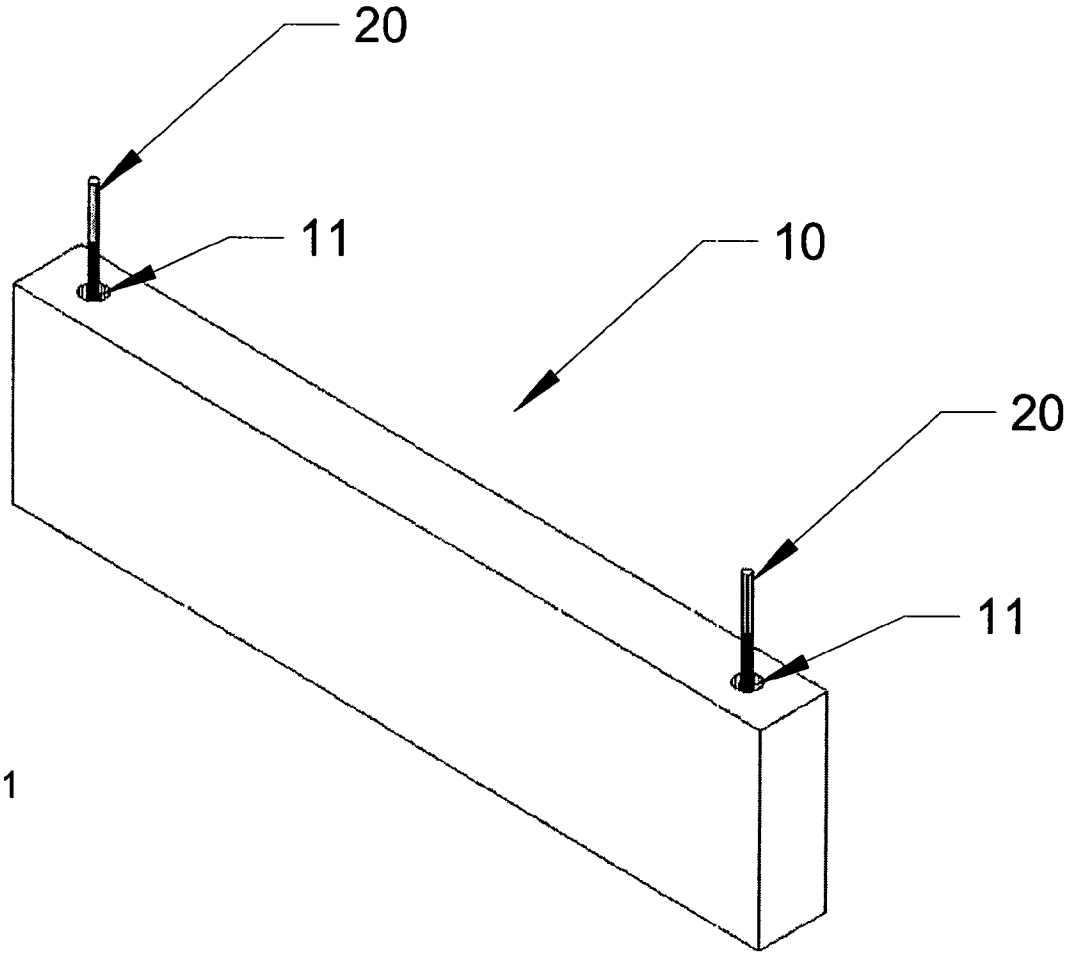
FIG. 1 is a perspective view of the invention.

FIG. 1 shows a stemwall 10 made of plastic foam. Holes 11 are created in the foam of the stemwall. Holes 11 can go completely through the stemwall or stop short of the end. Rebars or other metal stock 20 are placed in the holes 11, and GFRC 30 is poured into the space between the hole sides and the rebar.

Figure 2:
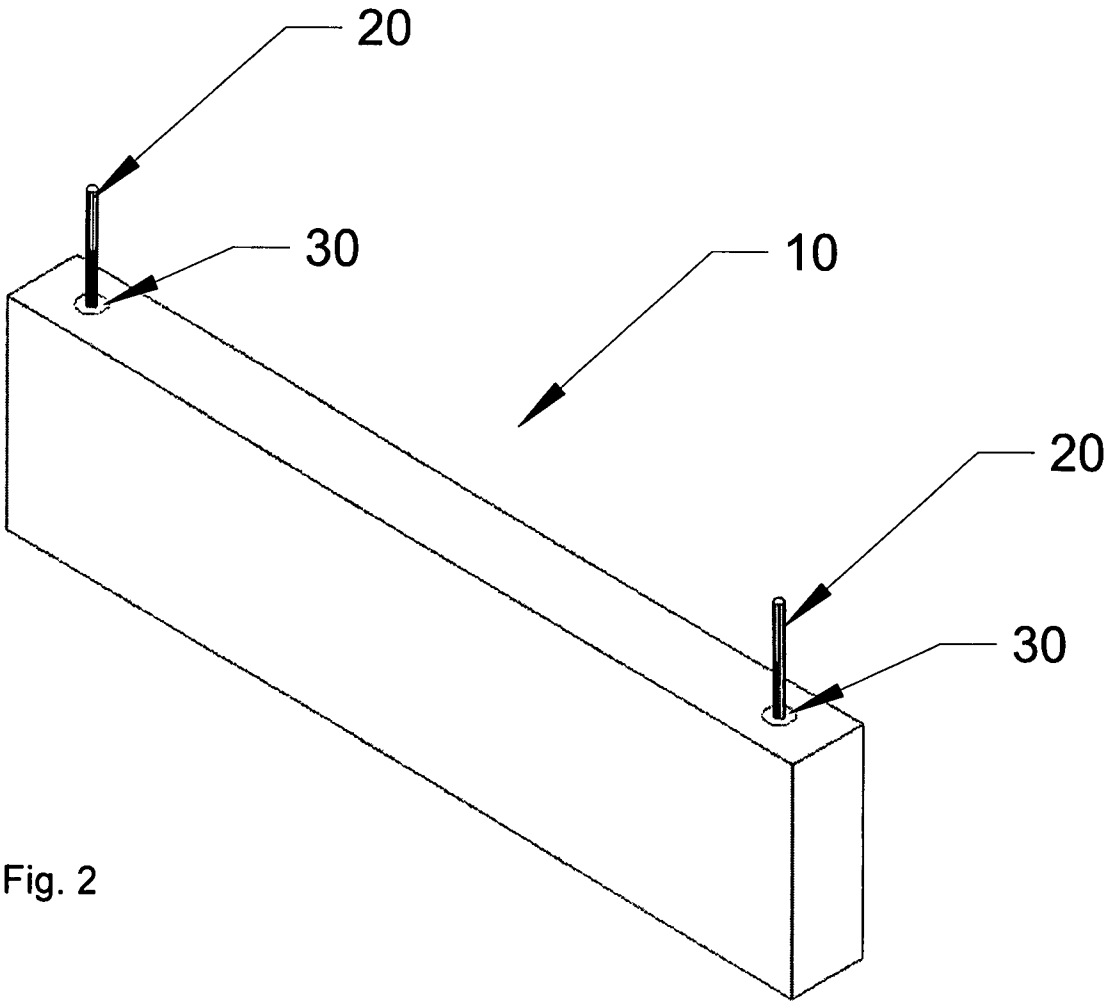
FIG. 2 is a perspective view of the invention.

FIG. 2 shows the same stemwall 10 with the GFRC 30 poured into the hole.

Figure 3:
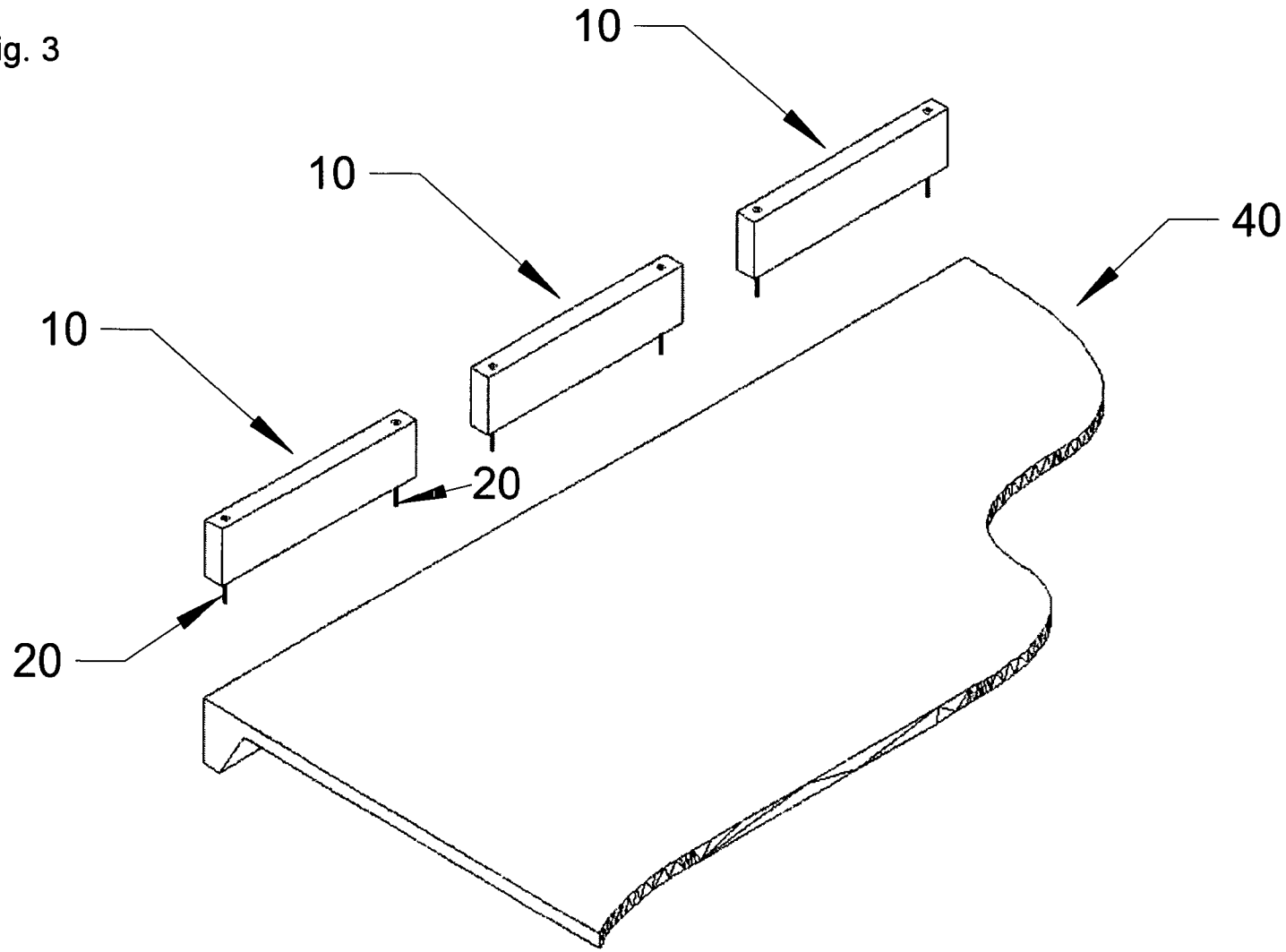
FIG. 3 is an exploded perspective view of the invention.

FIG. 3 shows three stemwalls 10 that have been flipped over and are positioned above the concrete slab or floor 40.

Preferably, the stemwalls 10 are placed on the slab with the rebar 20 being inserted or penetrating into the slab before the concrete has set.

Alternatively, if the concrete has set or the slab was already in existence (rebuild or remodel situation), then holes are made in the slab that align with the rebar in the stemwall. The rebar is then inserted into the holes and joined to the side walls of the slab by bonding with concrete, GFRC, another FRC, etc. or by a mechanical joint system.

Alternatively, holes can be made in the concrete slab, then rebars added and joined to the sides of the holes in the slab by conventional joint systems, then the stemwall is provided with holes aligned with the rebars, the stemwall is positioned around the rebars and then the GFRC is poured into the holes around the rebars.

When an addition to a building with a composite floor slab is added to an existing building having a concrete slab, holes can be drilled in the side of the concrete slab, rebar can be placed in the holes and joined to the slab and the foam floor can be joined to the rebar with GFRC placed in holes in the foam floor surrounding the rebar, just as the stemwall is joined to an existing concrete slab.

Figure 4:
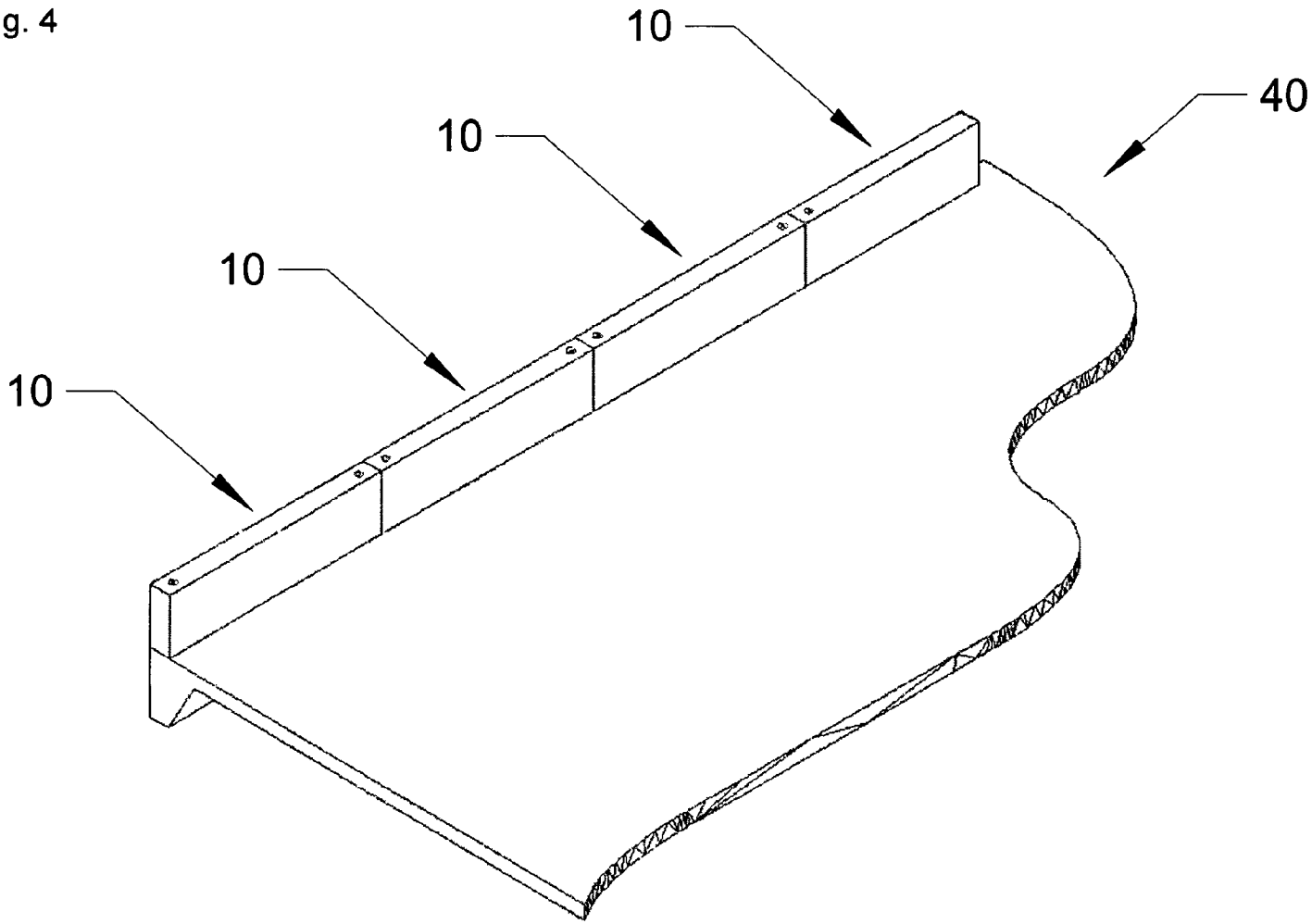
FIG. 4 is a perspective view of the invention.

FIG. 4 shows four of the stemwalls 10 positioned on the newly poured slab 40 with the rebar 20 extending into the slab to be bonded/joined thereto.

Figure 5:
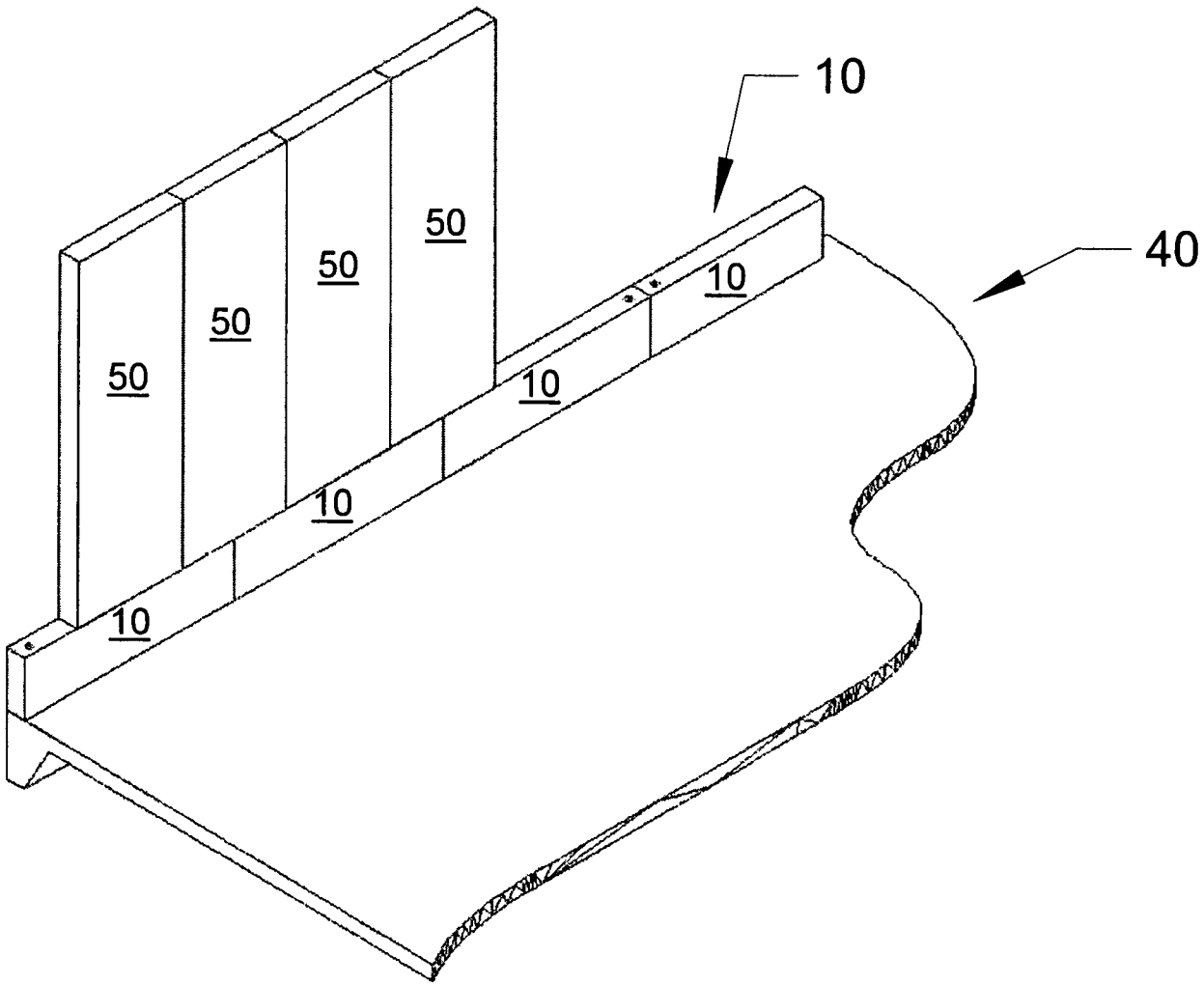
FIG. 5 is a perspective view of the invention.

FIG. 5 shows main outer walls 50 added to the stem walls 10 to form the outer walls of the composite building. The main walls 50 are bonded to the stemwalls 10 using a suitable bonding agent.

Figure 6:
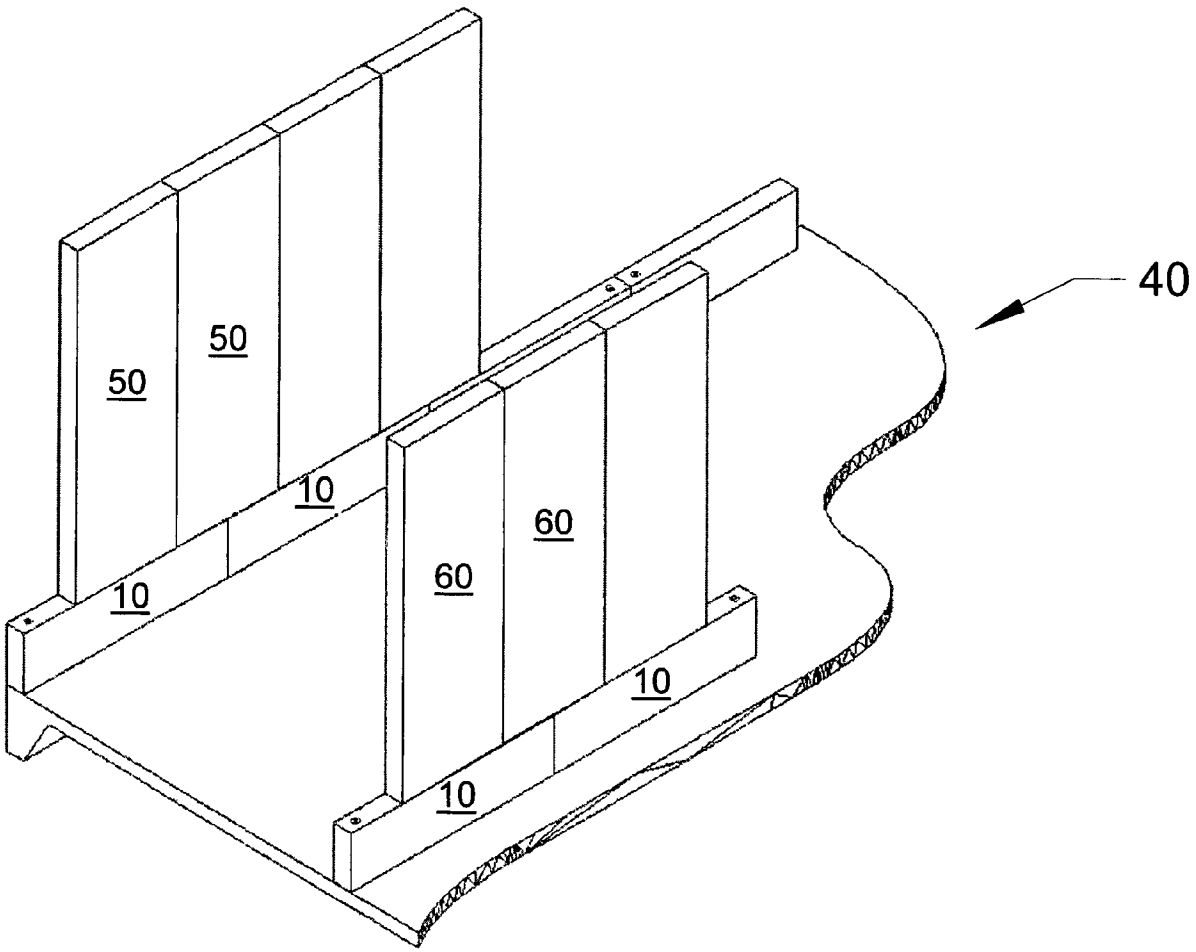
FIG. 6 is a perspective view of the invention.

FIG. 6 shows main inner walls 60 added to the stemwalls 10 forming the interior walls of the building.

After the main walls 50 and 60 are added to the stem walls 10, the main walls and the stemwalls are coated with GFRC. The GFRC need not extend on to the slab since it is not needed to structurally connect the walls to the slab. The space between the GFRC and the slab can be filled with an elastomeric sealant or other sealants.

The rebar can be No. 4 which is ½ inch in diameter. The rebar should not be less than ½ inch in diameter. Preferably, the rebar has a textured or other type of surface that increases the bonding strength between the rebar and the concrete and the GFRC. Rebar with a hook or L-shaped end is preferred. The rebar can extend twelve inches in the stemwall and 2½ inches with a hook in the interior of the slab and 4 inches or more with a hook in the perimeter of the slab.

As an example, the bond between the GFRC and the foam is equal to the perimeter of the hole times the length of the hole times the bond strength (40 psi for the SABS GFRC mix). With a safety factor of 3, the connection between the rebar and the foam can stand a force of 40 times the diameter of the hole times the length of the hole. Since GFRC mix strength can vary with the weather conditions during setting, composition of the mix, water content, etc., laboratory testing is necessary to understand what the proper dimensions of the hole should be to reach the desired strength of the connection between the stemwall and the concrete slab or floor. The required strength will depend on the local building codes.

A GFRC formulation is:

1 bag of cement (Portland Cement Type III)—94 pounds,
No. 30 silica sand—100 pounds,
water and ice—25 pounds,
polymer (Forton™ VF-774)—9 pounds,
retarder (Daratard™ 17)—2-5 ounces,
plasticizer (Daracem™ 19)—2-6 ounces,
0.5 inch glass fibers (Cem-FIL™)—1.5 pounds and
1.5 inch glass fibers—1.5 pounds.

The holes in the stemwall can be two inches in diameter or larger if more strength is needed in the connection/joint between the GFRC and the foam core. More rebar and holes in each stemwall section can be added to increase the strength of the connection of the stemwall to the slab.

Various changes and modifications to the embodiments herein chosen for purposes of illustration will readily occur to those skilled in the art.

The FRC can be a Glass Fiber Reinforced Concrete (GFRC) or a Fiber Reinforced Polymer (FRP). The fibers can be plastic, glass, carbon, single-wall carbon nanotubes (SWNTs or Buckytubes), Aramid or other fibers. The Polymer can be Epoxies, Polyesters, Vinlyesters or other materials.

The coating also can be without fibers if the design loading is low enough. For the strongest structure, fibers should be added to the coating. The number of coats of the coating and the composition of those coats can be varied.

The type of plastic foam can be different from Expanded PolyStyrene (EPS). The EPS can have a density of 1.5 pounds per cu. ft. (nominal) which is actually 1.35 pounds per cu. ft. (actual). EPS was used because any Finite Element Analysis was done using EPS and GFRC. Suitable plastic foam could be PU, etc.

Bonding agents that bond foam to foam, foam to concrete and concrete to concrete can be structural or non-structural as certified by International Code Council (ICC). One structural bonding agent is Glass Fiber Reinforced Concrete (GFRC). A thickness of 0.25-0.50 inches is suitable.

A non-structural bonding agent can be expansive plastic foams, such as Expansive PolyUrethane (EPU), etc. This can be used where the joint strength need not be structural, such as a joint that is later covered with FRC to create structural strength.

The specific materials used to build the structure may be varied, such as the type of plastic foam, the bonding agents, the coatings, etc.

To the extent that such modifications and variations do not depart from the spirit of the invention, they are intended to be included within the scope thereof which is assessed only by a fair interpretation of the following claims.

I claim:

1. A method of connecting a first and second plastic foam structure having opposing major surfaces and a FRC or fiber reinforced coating on the opposing major surfaces to a concrete slab comprising the following steps, providing holes in the first plastic foam structure, providing metal members, bonding the metal members to the first plastic foam structure in the holes using a fiber reinforced coating, the metal members within the first plastic foam structure being bonded to the first plastic foam structure only, creating holes in the concrete slab, placing the metal members in the holes in the concrete slab, bonding the metal members to the concrete slab, bonding a second plastic foam structure to the first plastic foam structure, then coating with a FRC the opposing major surfaces of the first and second plastic foam structure such that the FRC does not connect to the concrete slab except through the metal members and first and second plastic foam structure.

2. The method of claim 1 wherein the first plastic foam structure being a plastic foam stemwall of a building.

3. The method of claim 1 wherein the FRC is glass fiber reinforced concrete.

4. A method of connecting a first and second plastic foam structure having opposing major surfaces and a FRC or fiber reinforced coating on the opposing major surfaces to a concrete slab comprising the following steps, providing metal members, fixing the metal members in the concrete slab, providing holes in the first plastic foam structure, bonding the metal members to the first plastic foam structure in the holes using a fiber reinforced coating, the metal members within the first plastic foam structure being bonded to the first plastic foam structure only, bonding a second plastic foam structure to the first plastic foam structure, then coating with a FRC the opposing major surfaces of the first and second plastic foam structure such that the FRC does not connect to the concrete slab except through the metal members and first and second plastic foam structure.

5. The method of claim 4 wherein the first plastic foam structure being a plastic foam stemwall of a building.

6. The method of claim 4 wherein the FRC is glass fiber reinforced concrete.

* * * * *